United States Patent [19]

Bunker et al.

[11] Patent Number: 5,018,423

[45] Date of Patent: May 28, 1991

[54] NECK ADJUSTMENT MECHANISM FOR STRINGED INSTRUMENTS

[76] Inventors: David D. Bunker, 11909 8th Ave. S.W., Seattle, Wash. 98146; David L. Bunker, 12334 S. Poney Express Rd., Draper, Utah 84020

[21] Appl. No.: 365,215

[22] Filed: Jun. 12, 1989

[51] Int. Cl.[5] ..... G10D 3/00

[52] U.S. Cl. ..... 84/293

[58] Field of Search ..... 84/293

[56] References Cited

U.S. PATENT DOCUMENTS

| | | | |
|---|---|---|---|
| 1,912,106 | 5/1933 | Turturro | 84/293 |
| 2,056,474 | 10/1936 | Low | 84/293 |
| 2,478,136 | 8/1949 | Stromberg | 84/293 |
| 2,964,985 | 12/1960 | Webster | 84/1.15 |
| 2,998,742 | 9/1961 | Pratt | 84/293 X |
| 3,159,072 | 12/1964 | Burns et al. | 84/293 |
| 3,251,257 | 5/1966 | Bunker | 84/267 |
| 3,396,284 | 8/1968 | Scherer | 310/8.3 |
| 3,396,621 | 8/1968 | Dycus | 84/293 |
| 3,483,303 | 12/1969 | Warner | 84/615 |
| 3,657,462 | 4/1972 | Robinson | 84/1.16 |
| 3,858,480 | 1/1975 | Schneider et al. | 84/1.16 |
| 3,974,730 | 8/1976 | Adams, Jr. | 84/291 |
| 4,004,485 | 1/1977 | Hiscott | 84/207 |
| 4,169,402 | 10/1979 | Wood | 84/291 |
| 4,241,637 | 12/1980 | Brent | 84/1.16 |
| 4,373,417 | 2/1983 | Wilson et al. | 84/1.16 |
| 4,432,267 | 2/1984 | Feller | 84/293 |
| 4,530,268 | 7/1985 | Starrett | 84/1.16 |
| 4,557,174 | 12/1985 | Gressett, Jr. | 84/293 |
| 4,580,480 | 4/1986 | Turner | 84/1.14 |
| 4,620,470 | 11/1986 | Vogt | 84/314 R |
| 4,722,260 | 2/1988 | Pigozzi | 84/314 R |

FOREIGN PATENT DOCUMENTS

| | | | |
|---|---|---|---|
| 248509 | 2/1948 | Switzerland | 84/293 |

*Primary Examiner*—Lawrence R. Franklin

*Attorney, Agent, or Firm*—Thorpe, North & Western

[57] ABSTRACT

A stringed instrument having a body portion and a neck extending from the body portion wherein the neck includes mounting end attachable to the body portion, a distal end and an intermediate section including means for attachment of a fingerboard. An enclosed channel extends from the mounting end of the neck along a central axis to an opening at the distal end, providing a housing for a rigid bar disposed within the channel. This bar includes (i) an adjustment end positioned near the instrument body, (ii) a distal end extending toward the distal end of the neck, and (iii) a transverse pivot support coupled at an intermediate section of the bar and journaled within the neck. The height and width dimensions provide a close fit of the bar within the channel at a distal end thereof such that displacement of the distal end of the bar along a vertical or rotational axis results in corresponding displacement of the distal end of the neck in a bi-directional, controlled member. An adjustment mechanism interlocks with the adjustment end of the bar to provide full control in both upward and downward directions. Rotational adjustment is enabled by additional mechanisms which impose an angular force to the bar.

12 Claims, 1 Drawing Sheet

NECK ADJUSTMENT MECHANISM FOR STRINGED INSTRUMENTS

BACKGROUND OF THE INVENTION

1. Field of Invention

The present invention relates to stringed instruments which include a neck and finger board extending the supported strings away from the body of the instrument. More particularly, the present invention relates to a mechanism for correcting vertical and/or rotational misalignment in the neck of the stringed instrument.

2. Prior Art

Typical stringed instruments such as guitars, banjos, mandolins and other strummed instruments which have a significant amount of force applied to the neck of the instrument by reason of a plurality of strings in tension require accurate positioning of the fingerboard with respect to the array of strings. Such positioning is even more critical where frets are inlaid in the fingerboard to enable pitch selection for any selected string by depressing one or more fingers on a distal side of the fret from the resonating chamber or pickup part associated with the body of the stringed instrument. Although reference hereafter shall be made to an electric guitar, it will be apparent to those skilled in the art that the principles of this invention could be applied to other stringed instruments which share common construction design. Accordingly, further reference to the specific stringed instrument categorized as a guitar should be deemed to include other stringed instruments of comparable structure.

Proper alignment of the fingerboard of a guitar with respect to the suspended strings is essential. Although spacing and height displacement of strings from the fingerboard can be partially adjusted by the use of a specifically configured bridge or nut, it is preferred that the fingerboard of a guitar be essentially flat (meaning nontwisted) so that initial adjustments of the fingerboard position with respect to the rest of the instrument can be made in a predictable and controlled manner. In conventional fabrication of guitars, the neck is slightly bowed, further adjustments must be made to not only properly position the fingerboard with respect to the strings, but also to correct such misalignments. Such corrections are very difficult where the fingerboard is not initially flat, and compensation is virtually impossible when attempted from the outset for an extreme bow or twisted neck structure.

It has been reported that as many as 60% of the carved wood neck components prepared in typical fabrication procedures are simply discarded where initial misalignment is detected. For example, even though an artisan may start with a piece of hard wood which is straight and true in its rough form, as sections of the hard wood are cut away to form the tapering neck body, existent stresses within the wood may cause its configuration to slightly bow or twist. Such misalignment is unacceptable in finer instruments and typically results in the component being discarded.

Even where the neck structure remains acceptable after initial tooling, when applied to the guitar and subjected to stringed forces of 175 to 200 pounds compression, misalignment of the neck structure may result. Because of the unpredictable response of wood composition, guitar neck components cannot easily be prestressed to allow compensation for adjustments resulting from the described string pressure or loading which are imposed upon the neck.

Some adjustment has been facilitated by the use of a truss rod such as is illustrated in U.S. Pat. No. 3,396,621 or 4,557,174. The function of a truss rod is to redistribute loading forces imposed upon the neck to hopefully correct misalignment in the vertical bow which may occur with respect to the fingerboard and neck structure. It is important to note that the truss rod does not prevent loading of forces within the neck, but merely complements existing forces imposed by the strings to hopefully straighten or correct misalignment.

U.S. Pat. No. 4,432,267 illustrates a modular approach to providing for pre-strung adjustment in the neck component of the guitar by segmenting the neck and providing bolted attachment to the guitar body. Adjustment is accomplished by shifting the neck position with respect to the guitar body before tightening bolts which secure the neck to body orientation. This modular design has not provided the stability required for maintaining tuning nor for correcting other forms of misalignment. It is also cumbersome to adjust.

Furthermore, the prior problems of stress-imposed changes within the neck structure continue to be troublesome because forces arising from strings in tension can also affect distortion in the neck structure, particularly where weather conditions, heat and humidity might affect the wood. Therefore, a common impediment to construction and maintenance of a flat fingerboard and predictably straight neck body is the loading of the neck structure with the forces imposed by the tightly strung strings. Such stress may adversely affect any guitar in which string tension is applied to the neck in conventional manner.

In an earlier invention, the present inventors disclosed the use of a rigid, metal bar for relieving string tension from the supporting neck and fingerboard structure. This invention was described in U.S. Pat. No. 3,251,257, which explained that a rod could be inserted down a channel within the neck structure such that string tension applied at a distal end of the neck and fingerboard was loaded through the rigid bar into the guitar body. In this manner, the wood structure of the neck was not subjected to the severe tension and stress by reason of tightly drawn strings.

In addition, the referenced patent disclosed the use of a lifting force applied by contact of a threaded screw at the underside of the bar near the guitar body. For example, FIG. 2 of this patent illustrates adjustment screw 39 which is mounted at a support plate 39' and has its distal end contacting within a notch at the underside of the bar. This permits tension to be applied at one side of the bar as the screw is rotated inward, thereby countering the tension applied the strings 16. Accordingly, this earlier patent disclosed an adjustment mechanism which utilized the opposition of string tension versus bar tension in the vertical plane of the instrument to enable adjustment of the fingerboard and neck upward or downward. The limitations of such adjustment were controlled in part by the structural response of the neck material, the strings and string forces, and counter force established by the bar.

Although this mechanism provided improved adjustability along the vertical plane of the fingerboard, such adjustability was primarily limited to retracting the distal end of the fingerboard rearward by rotating the screw inward against the underside of the bar. Adjustments in the opposing direction were not as manageable because they depended upon the tension applied by the strings of the instrument. As guitar strings have become of lighter gauge, the difficulty of counter adjustments have increased.

In addition, the degree of abusive handling of instruments has greatly increased by virtue of modern performance styles, theatrics and attached hardware. For example, not only may a performance include swinging the guitar by its neck as part of performance choreography, but the use of tremolo bars and other hardware add greatly to the stress applied to the instrument, often resulting in mechanical misalignment of the fingerboard and neck structure.

It would therefore be beneficial to have an adjustment mechanism for maintaining and/or correcting alignment of the fingerboard of a guitar which does not depend on string tension and is capable of bearing stress applied in any form, whether it be by changes of weather, performance techniques or use of manipulative hardware associated with the instrument. Such progress would not only provide savings in the manufacture of such instruments, but would likewise reduce costs in correction of misalignment and difficulty of maintaining true pitch with respect to the strings of the instrument on a prolonged basis.

OBJECTS AND SUMMARY OF THE INVENTION

It is accordingly an object of the present invention to provide an adjustment mechanism which enables vertical adjustment of the fingerboard and neck structure of a guitar or similar stringed instrument in both upward and downward direction without regard to string tension.

It is a further object of the present invention to provide a mechanism which enhances stability of any adjustments made to the relative position of the fingerboard and neck structure and retains such an adjusted position over longer durations of time, despite abusive handling or adverse conditions with respect to the instrument.

A still further object of the present invention is to provide an adjustment mechanism which not only enables controlled manipulation of the fingerboard in upward and downward directions, but also enables rotational twisting of the fingerboard to compensate for misalignment of an angular nature.

Yet another object of this invention is to provide for a locking device for use in connection with the adjustment mechanism described hereafter which enhances the rigid interlocking of various components of the neck and peg head to increase strength and insure retained pitch for long durations and despite abusive handling of the instrument.

These and other objects are realized in a stringed instrument having a body portion with a mounting end attachable to the body portion, a distal end from which strings are suspended and an intermediate section including means for attachment of a fingerboard. The invention comprises an enclosed channel extending from the mounting end along a central axis of the neck to an opening at the distal end and having a channel cross-section which is defined by predetermined height and width dimensions relative to the fingerboard. A rigid bar is disposed within the channel and has (i) an adjustment end positioned near the instrument body, (ii) a distal end extending toward the distal end of the neck, and (iii) a transverse pivot support coupled at an intermediate section of the bar and journaled within the neck. The bar is configured with height and width dimensions which provide a close fit for the distal end of the bar within the neck such that displacement of the distal end of the bar along the vertical axis normal to the fingerboard in either upward or downward direction results in a corresponding upward or downward displacement of the distal end of the neck. A threaded adjustment means is coupled at one end thereof to the neck near the mounting end and at a second end to the adjustment end of the bar in approximate vertical relationship with respect to the fingerboard to provide bi-directional adjustment in a controlled manner to the support bar in both upward and downward direction and about the pivot support upon rotation of the threaded adjustment means.

The invention further includes utilization of a rotational biasing means which is coupled to the bar near its adjustment end and operable to apply rotational force to the bar about its axis to impose a degree of angular twist to the neck for adjustment purposes. Accordingly, both vertical and angular adjustment can be effected through applicational forces at a single bar which extends within the neck and bears most of the load of string tension applied to the instrument.

Further contemplated is the use of a rigid, stabilizing plate which is sandwiched between the respective support faces of the distal end of the neck and an attached peg head. This stabilizing plate includes a projecting shoulder flange which locks the peg head and attached bar against rotation with respect to the neck structure. In combination, this stabilizing plate, support bar, and vertical/rotational adjustment mechanism enable full control of fingerboard configuration, despite changes in wood structure, stress loading, adverse use, or accidental damage to the instrument.

Other objects and features of the present invention will be apparent to those skilled in the art based upon the following detailed description, taken in combination with the accompanying drawing.

DETAILED DESCRIPTION OF THE INVENTION

Referring now to the drawings

Figure 1:
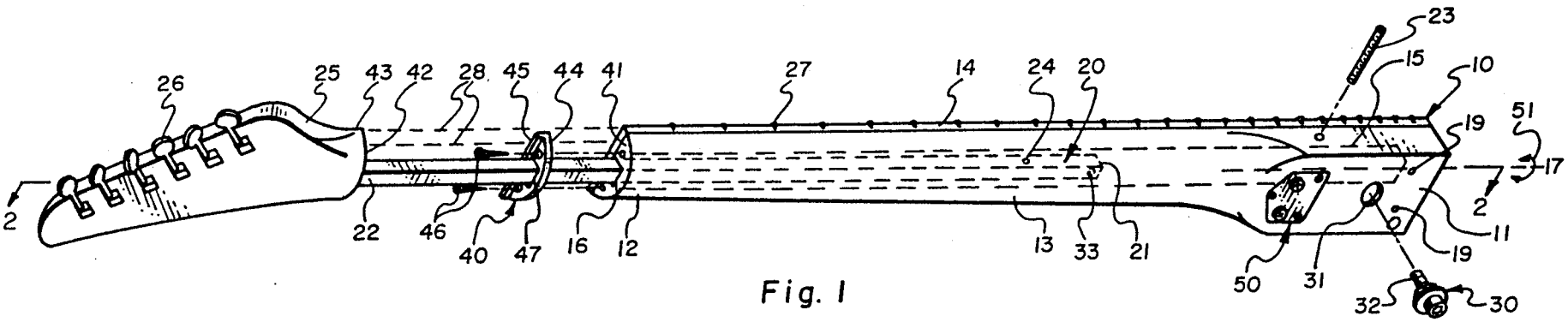
FIG. 1 shows a partially exploded, perspective view of a fingerboard/neck structure, including a peg head for suspending strings of the instrument over the fingerboard.

FIG. 1 shows a guitar neck 10 which includes a mounting end 11, a distal end 12 and an intermediate section 13 which includes means for attachment of a fingerboard 14. Included within the neck is an enclosed channel 15 which extends from the mounting end 11 to an opening 16 at the distal end of the neck. This channel extends substantially along a central axis 17 of the neck and has predetermined height and width dimensions relative to the fingerboard that shall be described hereafter. The mounting end 11 includes openings 19 for screws to attach the neck to a guitar body (not shown).

A rigid bar 20 is disposed within the channel 15 and includes an adjustment end 21 which is to be positioned near the instrument body, a distal end 22, and a transverse pivot support 23 and support opening 24 within an intermediate section of bar. The distal end of the bar 22 is rigidly attached to a peg head 25 which may include attendant tuning structure 26. This attachment is of a very sturdy nature to insure no relative rotational movement or other form of displacement between the peg head 25 and bar 22.

It should be noted that the described neck and peg head components may be fabricated of conventional material such as wood or plastics; however, the neck is preferred to be of hard wood such as eastern maple or the like. Typically, the fingerboard is of rose wood composition and the frets 27 are of metal.

Because the bar 20 bears most of the load imposed upon the neck by virtue of strings 28 (shown in phantom line), its composition needs to be of rigid steel or other material capable of resisting such loads, and also of imposing adjustment forces appropriately within a neck structure. Cold rolled steel retains its memory and is preferred for the bar because it maintains its orientation upon adjustment.

Figure 2:
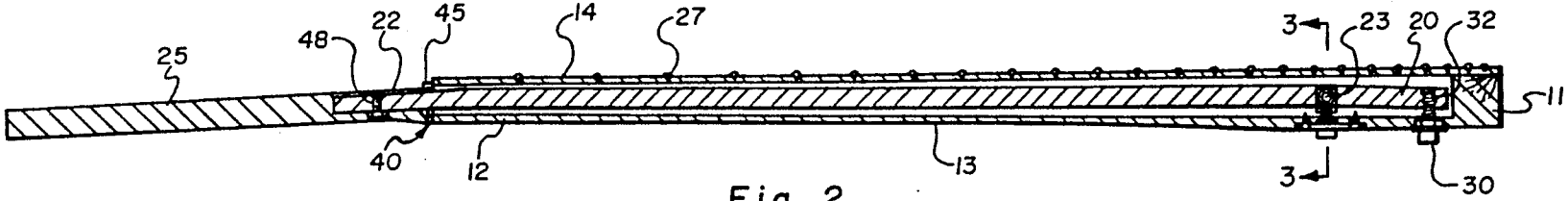
FIG. 2 shows a cut away view taken along the lines 2—2 of FIG. 1.

The preferred embodiment of bar illustrated herein is of rectangular configuration having height and width dimensions which provide a close fit for the distal end of the bar 22 within the neck 12. This enables displacement of the distal end of the bar along a vertical plane normal to the fingerboard in either upward or downward direction, resulting in a corresponding upward or downward displacement of the distal end of the neck. This displacement is accomplished by threaded adjustment means 30 which is fixed rigidly in place by means of a washer and nut assembly at opening 31 so that a threaded portion 32 of the adjustment means 30 is engageable at a threaded opening 33 in the adjustment end 21 of the bar. This is illustrated more clearly in FIG. 2, showing a cross section of the assembled configuration.

It will be apparent that the threaded adjustment means 30 be rotated clockwise or counterclockwise and will be retained in its relative position with respect to the neck structure, while the coupled bar 20 will raise or lower, depending upon the direction of rotation of the threaded screw portion 32. This is in direct contrast to the prior patent of the present inventors U.S. Pat. No. 3,251,257 wherein the adjustment mechanism was merely contacted at an underside of the bar, and lacked the desired control, as well as the bi-directional displacement ability provided in the present invention. This bi-directional displacement occurs about a pivotal support axis defined by the transverse pivot support 23 which provides a fulcrum position for the adjustable bar.

An additional feature of the present invention is a uniquely designed stabilizing plate 40 which rigidly ties the peg head 25 to the distal end 12 of the neck. This stabilizing plate 40 is positioned between mounting support faces 41 and 42 at juxtaposed ends of the neck and peg head respectively. This support face 43 of the peg head includes an adjacent planar shoulder 43 at an upper edge therefor for abutting at a corresponding portion of the mounting support face 41 of the neck. This rigid stabilizing plate includes a plate member 44 and a locking flange 45 approximately normal to the plate 44. The dimensions of the plate and locking flange are such that the flange 45 barely projects over the shoulder 43 of the peg head. This is more clearly illustrated in FIG. 2, where the flange 45 is illustrated in its locking position over the shoulder of the peg head.

Because the plate member is firmly secured to the face 41 of the neck by screws 46, the stabilizing plate 40 is immovable with respect to the neck. The locking flange 45 secures the peg head 25 against rotation, based on the close contact of the flange 45 and shoulder 43. This contact is maintained by proper dimensioning of a plate opening 47 in the plate member 44 which corresponds in configuration to a cross section of the bar 22. This opening is aligned with the axis 17 of the bar such that the close fit of the bar within opening 47 and the abutment of shoulder 43 against the locking flange 45 make the separable members of the neck and peg head (with bar coupled within the head by screw 48) immovable.

This locking plate may be fabricated of various rigid materials such as high strength polymer, composites of polymer and reinforcement fiber, and metals of various types. For example, aluminum and brass are both easily tooled or formed into the appropriate plate configuration. It should be noted that the selection of materials directly affects the nature of tone developed by the instrument. Utilization of a brass stabilizing plate develops a brighter sound with higher harmonics and timbre. In contrast, reinforced composite material tends to dampen the sound and generate a more subdued or dark timbre. High tensile polymers such as KEVLAR (TM) fall in the midrange, with aluminum providing a response more toward the brighter sound of the brass plate. The variety of sound and ability to control tonal quality by selection of various compositions for the stabilizing plate 40 is an unexpected benefit developed by virtue of the combination of the components provided in the present invention.

Additional adjustment capabilities are provided by the present invention in a rotational biasing means 50 which enables rotational adjustment 51 about the bar axis 17, complementing the upward and downward adjustment enabled by the threaded member 30. This rotational biasing means 50 is coupled to the bar near its adjustment end 15 and operates to apply a rotational force 51 along the bar to thereby impose a degree of angular twist to the neck. This aspect of the invention is more clearly illustrated in FIG. 3.

Figure 3:
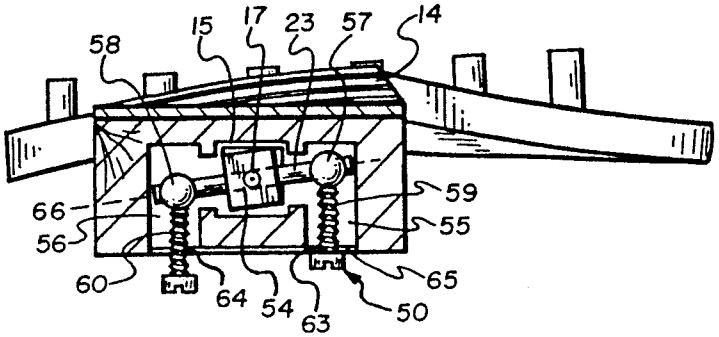
FIG. 3 shows a cut away view taken along the lines 3—3 of FIG. 2, detailing rotational adjustment structure of the present invention.

FIG. 3 illustrates one embodiment of the rotational biasing means 50 wherein means are provided for imposing angular displacement to the transverse pivot support 23 which operates as a fulcrum point for vertical adjustment of the bar. In this embodiment, the pin 23 is dimensioned to fit closely within the traverse opening 54 at the pivot point of the bar. Vertical channels 55 and 56 are cut into the neck structure and communicate with the bar channel 15. Opposing ends of the pin 23 extend to each of these vertical channels and interlock with an annular receiving member 57 and 58 wherein the annulus receives the distal ends of the pin 23. Each receiving member 57 and 58 is coupled to a biasing screw 59 and 60 which is threaded and journaled in a threaded opening 63 and 64 of a rigid mounting plate 65.

Operation of the rotational biasing means is accomplished by counter rotating the respective biasing screws 59 and 60 to provide a counter force mechanism at opposing ends of the pin 23, causing the pin to twist about the axis 17 of the bar. This loads a rotational force on the bar along its length, causing the more narrow portion of the neck 12 to twist in the manner illustrated in FIG. 3. In this figure, the fingerboard 14 is shown twisted in a counter clockwise direction in response to the respective raised 59 and lowered 60 biasing screws. It will be apparent to those skilled in the art that this figure is greatly exaggerated and that the degree of twist actually opposed would barely be perceptible to the human eye. Accordingly, FIG. 3 has rotational movements which are greatly enhanced.

The use of two biasing screws 59 and 60 in FIG. 3 assist in stabilizing the rotated bar in a fixed position. For example, a single biasing screw in the illustrated configuration would permit the bar to shift somewhat, depending upon the amount of channel space 15 available. The two biasing screws cooperate to fix the relative position of the pin axis 66 and the bar axis 17 so that an adjustment which is made to the fingerboard remains fixed and stable.

Figure 4:
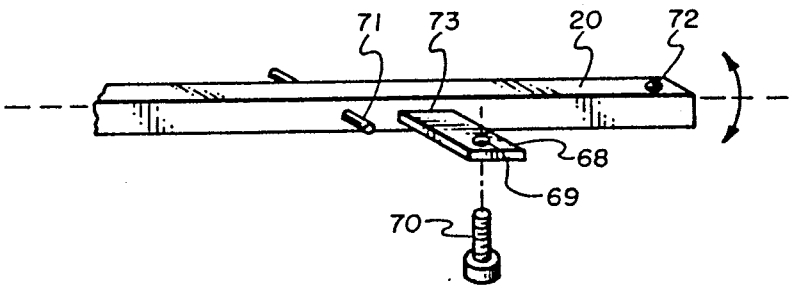
FIG. 4 shows an alternate embodiment of the rotational structure illustrated in FIG. 3.

FIG. 4 illustrates an additional example of a means for biasing the bar 20 to a rotated configuration with results similar to those shown in FIG. 3. Specifically, this embodiment includes a lateral tab 68 having a threaded opening 69 for receiving a biasing screw 70. This biasing screw would be secured through a plate 65 as shown in FIG. 3. An advantage of the latter embodiment is its displacement from the pivot pin 71 which is utilized to provide the vertical displacement associated with threaded opening 72, as illustrated in FIG. 2 with item 30. The tab is adjusted upward or downward to impose appropriate rotation and provides the desired stability because of its rigid attachment 73 to the bar. Such attachment may be by welding or other permanent fixation.

Each structural features are generally representative of a general method for bi-directional controlling orientational adjustment of the neck and fingerboard at any given plane of a stringed instrument. For example, for a plane which is normal to the fingerboard and coplanar with the axis of the bar, vertical adjustment would apply. For a plane which is normal to the axis of the bar (forming a cross section in the bar and neck), the adjustment would be rotational. The actual steps of the inventive method are applied with respect to an instrument which includes a rigid bar disposed within a channel as previously described herein, located within the neck and extending along the length of the neck as is shown in FIG. 2.

The method is practiced by providing a close dimensional fit between the distal end of the bar and within the distal end of the channel such that bi-directional displacement of the distal end of the bar along the rotational or vertical axis results in a corresponding displacement of the distal end of the neck. In other words, forces applied to the bar are transferred from the side walls of the bar or by comparable structure to the interior walls of the channel such that the neck is displaced or twisted accordingly.

A second step of this method involves coupling a bi-directional, threaded adjustment mechanism (previously described as either item 30 or item 50) to the adjustment end of the bar, and then rotating and/or counter rotating this threaded adjustment mechanism to impose bi-directional displacement forces therefrom to the end of the bar.

More specifically, vertical adjustment is accomplished by coupling the threaded adjustment mechanism through a threaded opening 33 in the adjustment end of the bar and by rotating the adjustment mechanism clockwise or counter clockwise to enable the desired vertical adjustment in either upward or downward directions. Rotational adjustment is similarly accomplished by coupling the threaded adjustment mechanism to the adjustment end of the bar in tangential, offset relationship with the bar axis and then rotating the mechanism to apply rotational force to the bar.

The advantages of the present invention in broad context extend from initial stages of construction, up through the final use of the instrument in actual performance. For example, the various adjustments available with the present invention enable greater utility for necks which may be deformed in fabrication procedures. Instead of throwing the neck away, vertical or rotational adjustments are applied after assembly to straighten the neck to a proper orientation. A major advantage of the present invention is that such adjustments can be made without strings mounted on the guitar, as has been required by prior art structures and methods. In contrast, the present invention permits bi-directional adjustment both upward and downward, and in rotational and counter rotational orientation without strings, trusses or other exterior forces. Furthermore, because the bar is tied into the guitar body with full adjustment capability, much improved retention of tuning pitches is provided, despite the most heavy application of tremolo and other rough forms of treatment.

The present invention even permits greater versatility in finish work on the instrument and enhanced capability for extended warranty. For example, whereas prior instruments were seldom warranted unless the neck was totally sealed by varnish or other finishes from the effects of humidity and weather, the present instrument does not require such a finish. If slight deflection occurs because of weather conditions, or even abuse, the neck can be straightened by making appropriate vertical and rotational adjustments to the bar which carries the dominant load of force imposed by the guitar strings. This mechanism therefore enables extended warranties which can be honored by merely making adjustments within the neck adjustment structure. These are only a few of the examples and benefits that arise because of this greatly advanced adjustment mechanism.

It will be apparent to those skilled in the art that these methods can be practiced with respect to stringed instruments of a variety of construction and that the specific structure disclosed in this description is merely exemplary of several preferred embodiment thereof. Accordingly, it is to be understood that the claims are not to be limited by the specific examples provided herein, but are to be construed in accordance with the following claims.

We claim:

1. A stringed instrument having a body portion and a neck extending from the body portion, said neck including:

a mounting end attachable to the body portion, a distal end and an intermediate section including means for attachment of a fingerboard;

an enclosed channel extending from the mounting end along a central axis of the neck to an opening at the distal end and having a channel cross-section defined by predetermined height and width dimensions relative to the fingerboard;

a rigid bar disposed within the channel and having (i) an adjustment end positioned near the instrument body and within the neck, (ii) a distal end extending toward the distal end of the neck, and (iii) a transverse pivot support coupled at an intermediate section of said bar and journaled within the neck;

said bar having corresponding height and width dimensions which provide a close fit for the distal end of the bar within the neck such that displacement of the distal end of the bar along a vertical axis normal to the fingerboard in either upward or downward direction results in a corresponding upward or downward displacement of the distal end of the neck;

threaded adjustment means coupled at a first end to the neck near the mounting end and at a second end to the adjustment end of the bar in approximate vertical relationship with respect to the fingerboard to provide bi-directional adjustment in a controlled manner to the rigid bar in both upward and downward direction about the pivot support upon rotation of the threaded adjustment means.

2. A stringed instrument as defined in claim 1, wherein the adjustment end of the bar includes a threaded opening in vertical relationship with respect to the threaded adjustment means, said adjustment means comprising a screw rotationally mounted in a vertically fixed relationship with respect to the neck such that rotation of the screw within the threaded opening of the bar causes a controlled displacement upward or downward of the adjustment end and an opposing downward or upward movement of the distal end of the bar.

3. A stringed instrument as defined in claim 1, said instrument further including a peg head rigidly coupled to the distal end of the bar and including peg means for attachment of strings for suspending over the fingerboard.

4. A stringed instrument having a body portion and a neck extending from the body portion, said neck including:

a mounting end attachable to the body portion, a distal end and an intermediate section including means for attachment of fingerboard;

an enclosed channel extending from the mounting end along a central axis of the neck to an opening at the distal end and having a channel cross-section defined by predetermined height and width dimensions relative to the fingerboard;

a rigid bar disposed within the channel and having (i) an adjustment end positioned near the instrument body and within the neck, (ii) a distal end extending toward the distal end of the neck, and (iii) a transverse pivot support coupled at an intermediate section of said bar and journaled within the neck;

said bar having corresponding height and width dimensions which provide a close fit for the distal end of the bar within the neck such that displacement of the distal end of the bar along a vertical axis normal to the fingerboard in either upward or downward direction results in a corresponding upward or downward displacement of the distal end of the neck;

threaded adjustment means coupled at a first end to the neck near the mounting end and at a second end to the adjustment end of the bar in approximate vertical relationship with respect to the fingerboard to provide bi-directional adjustment in a controlled manner to the rigid bar in both upward and downward direction about the pivot support upon rotation of the threaded adjustment means;

said instrument further including a peg head rigidly coupled to the distal end of the bar and including peg means for attachment of strings for suspending over the fingerboard;

said peg head including a mounting support face and adjacent planar shoulder at an upper edge thereof for abutting at a corresponding mounting support face of the neck, said instrument further including a rigid, stabilizing plate sandwiched between the respective mounting support faces of the peg head and neck and including a locking flange coupled at a top edge of the stabilizing plate and projecting over the shoulder of the peg head to restrain the peg head against rotational movement about an axis of the bar, said plate being securely fastened to the mounting face of the neck and having an opening aligned with the channel with dimensions only slightly larger than the height and width dimensions of the bar to provide reinforcement to the bar with a slidable, close fit therebetween.

5. A stringed instrument as defined in claim 4, wherein the stabilizing plate is fabricated from a composition selected from the group consisting of high strength polymers composites of polymer and reinforcement, and metal.

6. A stringed instrument as defined in claim 5, wherein the plate is fabricated from brass.

7. A stringed instrument as defined in claim 4, wherein the bar, channel and plate opening are rectangularly configured and sized to restrain relative rotational movement of the distal end of the bar with respect to the distal end of the neck.

8. A stringed instrument as defined in claim 7, further comprising rotational biasing means coupled to the bar near its adjustment end and operable to apply a rotational force to the bar about its axis to impose a degree of angular twist to the neck for adjustment purposes.

9. A stringed instrument as defined in claim 8, wherein the rotational biasing means comprises means for imposing angular displacement of the transverse pivot support and attached bar in a direction to create the desired angular twist.

10. A stringed instrument as defined in claim 8 wherein the pivot support comprises a pin dimensioned to fit closely within a transverse opening at a pivot point of the bar, said neck including at least one vertical channel for containing the rotational biasing means, said vertical channel being positioned laterally of the transverse pivot opening, at least one end of said pin extending into the vertical chamber;

said rotational biasing means comprising a threaded biasing screw positioned within the vertical chamber and having one end coupled to the extending end of the pivot pin within the chamber, said biasing screw including means for enabling rotational adjustment of the extending end about the bar axis.

11. A stringed instrument as defined in claim 10, wherein two vertical chambers are provided on opposing sides of the pivot point of the bar, with said pin extending at each end into the respective vertical chambers, each chamber including a threaded biasing screw positioned therein and in contact with the respective ends of the pin to provide a counter-force mechanism applied at the opposing ends of the pin for stabilizing the bar at a selected degree of rotational twist about the bar axis.

12. A stringed instrument as defined in claim 8, wherein the rotational biasing means comprises a lateral tab coupled to the bar, said neck including a channel lateral of the bar for housing the tab with sufficient room for the tab to be raised and lowered from a static position, said biasing means further including a threaded biasing screw coupled to the tab and means for enabling rotational adjustment of the tab for imposing a twist to the axis of the bar in a manner to correct an angular offset within the neck of the instrument.

* * * * *